US010685798B2

(12) United States Patent
Cernat et al.

(10) Patent No.: US 10,685,798 B2
(45) Date of Patent: Jun. 16, 2020

(54) INTERRUPTER UNIT FOR A CIRCUIT BREAKER

(71) Applicant: SIEMENS AKTIENGESELLSCHAFT, Munich (DE)

(72) Inventors: Radu-Marian Cernat, Berlin (DE); Volker Lehmann, Treuenbrietzen (DE); Andrzej Nowakowski, Berlin (DE); Frank Reichert, Weissenfels (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/322,977

(22) PCT Filed: Jul. 6, 2017

(86) PCT No.: PCT/EP2017/067000
§ 371 (c)(1),
(2) Date: Feb. 4, 2019

(87) PCT Pub. No.: WO2018/024435
PCT Pub. Date: Feb. 8, 2018

(65) Prior Publication Data

US 2019/0180963 A1 Jun. 13, 2019

(30) Foreign Application Priority Data

Aug. 2, 2016 (DE) ..... 10 2016 214 196

(51) Int. Cl.
*H01H 33/70* (2006.01)
*H01H 33/74* (2006.01)
(Continued)

(52) U.S. Cl.
CPC ..... *H01H 33/703* (2013.01); *H01H 33/74* (2013.01); *H01H 33/82* (2013.01);
(Continued)

(58) Field of Classification Search
CPC .. H01H 33/7023; H01H 33/703; H01H 33/74; H01H 33/78; H01H 33/901;
(Continued)

(56) References Cited

U.S. PATENT DOCUMENTS 5,978,200 A 11/1999 Konma et al.
6,078,485 A * 6/2000 Perdoncin ..... H01H 33/91 218/59
(Continued)

FOREIGN PATENT DOCUMENTS

CN 102945768 A 2/2013
CN 102985990 A 3/2013
(Continued)

OTHER PUBLICATIONS

Translation of EP0783173 (Original document filed Jul. 9, 1997) (Year: 1997).*

*Primary Examiner* — William A Bolton
(74) *Attorney, Agent, or Firm* — Laurence Greenberg; Werner Stemer; Ralph Locher

(57) ABSTRACT

An interrupter unit for a circuit breaker has two electrically conductive arcing contact pieces, which can be moved relative to one another along a switching path. An insulating nozzle has a nozzle channel through which the switching path runs. A heating volume is connected to the nozzle channel. A separating housing divides the heating volume into a cold gas region and a hot gas region. A cold gas duct runs through a nozzle channel end section of the nozzle channel and is connected to the cold gas region. A hot gas duct runs through the nozzle channel end section and is connected to the hot gas region.

12 Claims, 2 Drawing Sheets

(51) Int. Cl.
*H01H 33/82* (2006.01)
*H01H 33/90* (2006.01)
*H01H 33/91* (2006.01)

(52) U.S. Cl.
CPC ..... *H01H 33/90* (2013.01); *H01H 33/901* (2013.01); *H01H 33/91* (2013.01); *H01H 2033/906* (2013.01)

(58) Field of Classification Search
CPC ..... H01H 2033/908; H01H 2033/902; H01H 33/82; H01H 33/91; H01H 2033/888
USPC ..... 218/49, 46, 51, 53, 57, 59, 61, 63, 64
See application file for complete search history.

(56) References Cited

U.S. PATENT DOCUMENTS 8,030,590 B2 * 10/2011 Yoshida ..... H01H 33/905 218/57
8,598,483 B2 * 12/2013 Dienemann ..... H01H 33/703 218/46
8,633,413 B2 * 1/2014 Cernat ..... H01H 33/703 218/59
8,664,558 B2 * 3/2014 Bose ..... H01H 33/88 218/51
8,816,237 B2 * 8/2014 Dufournet ..... H01H 33/905 218/46
2007/0068904 A1 3/2007 Dahlquist et al.
2013/0056444 A1 3/2013 Cernat

FOREIGN PATENT DOCUMENTS

CN 204289255 U 4/2015
CN 105448592 A 3/2016
EP 0783173 A1 7/1997
EP 1768150 A1 3/2007
FR 2751462 A1 1/1998
JP 2910582 B2 6/1999
WO 2012139916 A1 10/2012

* cited by examiner

INTERRUPTER UNIT FOR A CIRCUIT BREAKER

BACKGROUND OF THE INVENTION

Field of the Invention

The invention relates to an interrupter unit for a circuit breaker. The interrupter unit has two electrically conductive arcing contact pieces, which are movable relative to one another along a switching path between a switch-off position, in which the arcing contact pieces are separated from one another by the switching path, and a switch-on position, in which the arcing contact pieces are in electrical contact with one another. In addition, the interrupter unit has an insulating nozzle at least partially surrounding the switching path.

In particular, the invention relates to an interrupter unit for a circuit breaker in the form of a so-called self-blast breaker. In the event of a switch-off operation, self-blast breakers convert energy released by an arc burning between the arcing contact pieces for a quenching pressure buildup for quenching the arc. For this purpose, an arcing chamber in which the arc burns is connected to a heating volume, in which insulating gas heated and expanded by the arc, insulating nozzle material released by ablation and thermal radiation out of the arcing chamber increase the gas pressure. The insulating gas in the heating volume is used to quench the arc. In the case of low flow intensities, the power converted in the arc does not effect sufficient pressure buildup in the heating volume, with the result that quenching gas compressed assistively by the movement sequence of the breaker is used.

SUMMARY OF THE INVENTION

The invention is based on the object of specifying an improved interrupter unit for a circuit breaker.

The object is achieved according to the invention by the features as claimed.

Advantageous configurations of the invention are the subject matter of the dependent claims.

An interrupter unit according to the invention for a circuit breaker comprises two electrically conductive arcing contact pieces, an insulating nozzle, a heating volume, a separating housing, a cold gas channel and a hot gas channel. The arcing contact pieces are movable relative to one another along a switching path between a switch-off position, in which the arcing contact pieces are separated from one another by the switching path, and a switch-on position, in which the arcing contact pieces are in electrical contact with one another. The insulating nozzle at least partially surrounds the switching path. A nozzle channel passes through the insulating nozzle and the switching path passes through said nozzle channel, said nozzle channel being connected to the heating volume. The separating housing splits the heating volume into a cold gas region and a hot gas region and has at least one connecting opening connecting the cold gas region to the hot gas region. The cold gas channel passes through a nozzle channel end section of the nozzle channel and is connected to the cold gas region of the heating volume. The hot gas channel passes through the nozzle channel end section of the nozzle channel and is connected to the hot gas region of the heating volume.

The interrupter unit is particularly advantageously suitable for a circuit breaker in the form of a self-blast breaker. In this case, the heating volume acts as a reservoir for storing insulating gas which is used for quenching an arc burning between the arcing contact pieces in the event of a switch-off operation. A switch-off operation is in this case understood to mean a movement of the arcing contact pieces from the switch-on position into the switch-off position. The hot gas channel makes it possible for insulating gas to be conveyed between the arcing chamber, in which the arc burns in the nozzle channel, and the heating volume. In the event of a switch-off operation, insulating gas heated and expanded by the arc is conveyed into the heating volume, and the pressure in the heating volume is increased. As has already been mentioned above, the power converted in the arc in the case of low flow intensities does not, however, effect sufficient pressure buildup in the heating volume, with the result that assistively compressed additional insulating gas is conveyed into the heating volume. The greater the heating volume is, the smaller the pressure increase in the heating volume owing to the additional insulating gas is at the same time. The splitting of the heating volume into a cold gas region and a hot gas region makes it possible for additional insulating gas to be conveyed only or predominantly into one of these regions and thus, as a result of the smaller volume of this region in comparison with the entire heating volume, for a greater pressure increase owing to the additional insulating gas to be achieved in this region than in the case where the additional insulating gas is distributed uniformly over the entire heating volume. As a result, the quenching effect of the additional insulating gas is advantageously increased.

One configuration of the invention provides that a first arcing contact piece has a contact end having a contact opening, into which the second arcing contact piece has moved in the switch-on position, and that the hot gas channel surrounds the contact end of the first arcing contact piece, while the cold gas channel surrounds the hot gas channel. Owing to the fact that the hot gas channel surrounds the contact end of the first arcing contact piece and the cold gas channel surrounds the hot gas channel, the hot gas channel is unblocked earlier than the cold gas region on separation of the arcing contact pieces. Therefore, pressure in the heating volume is built up via the hot gas channel at a time at which the cold gas channel is not yet unblocked. The delayed unblocking of the cold gas channel means that, at this time, the pressure difference between the arcing chamber and the heating volume is smaller, as a result of which only a small amount of hot gas passes via the cold gas channel into the heating volume too. If the arc loses intensity and a backflow of insulating gas out of the heating volume to the arc begins, insulating gas exits the heating volume both via the cold gas channel and via the hot gas channel. In this case, it is necessary to consider that there is a temperature gradient in the interior of the heating volume, as a result of which the cold gas flow is fed out of the cold gas region, while the hot gas flow is fed out of the hot gas region. By virtue of the joint action of the two channels, the arc is subjected to flow over a larger axial extent, and a pronounced dielectrically strengthened region is produced, which contributes to successful quenching.

One configuration of the invention provides a channel separating wall, which separates the cold gas channel and the hot gas channel from one another and is substantially in the form of a hollow cylinder, for example. A channel separating wall separating the cold gas channel and the hot gas channel from one another at the same time delimits the cold gas channel and the hot gas channel and therefore enables a design of the cold gas channel and hot gas channel that saves on component parts.

Preferably, the channel separating wall protrudes into the nozzle channel end section, and the cold gas channel is delimited by an outer surface of the channel separating wall and an inner surface, delimiting the nozzle channel end section, of the insulating nozzle. This configuration of the invention therefore provides that the cold gas channel forms an outer region of the nozzle channel end section, and the hot gas region forms an inner region of the nozzle channel end section. This enables the advantageous arrangement of the cold gas channel around the hot gas channel as previously described above.

A further configuration of the invention provides that the channel separating wall is part of the separating housing. Preferably, the channel separating wall in this case forms a housing end section, facing the switching path, of the separating housing. In addition, the separating housing is, for example, in the form of a funnel, wherein the channel separating wall forms a housing neck, which protrudes into the nozzle channel end section and which is adjoined by a housing body, which is arranged in the heating volume and has a greater inner diameter than the housing neck. The embodiment of the channel separating wall as part of the separating housing enables an integral embodiment of the separating housing and the channel separating wall and thus simplifies the production and fitting of the separating housing and the channel separating wall. The design of the channel separating wall in the form of a housing end section, facing the switching path, of the separating housing takes into consideration the fact that there is insufficient installation space for receiving the separating housing along the switching path since, in this region of the interrupter unit, the arcing contact pieces move relative to one another. The funnel-like design of the separating housing enables suitable splitting of the heating volume into a cold gas region and a hot gas region and the formation of the cold gas channel and the hot gas channel through the separating housing.

A further configuration of the invention provides that the nozzle channel widens toward the nozzle channel end section. This configuration of the invention enables or simplifies the arrangement of the cold gas channel and the hot gas channel in the nozzle channel end section.

A further configuration of the invention provides a compression volume, which is separated from the heating volume by a compression wall. The compression wall is coupled to an arcing contact piece, with the result that said compression wall reduces the size of the compression volume in the event of a relative movement of the arcing contact pieces from the switch-on position into the switch-off position. In addition, the compression wall has at least one compression wall opening, which is closed by an overflow valve when the pressure in the heating volume is greater than the pressure in the compression volume. This configuration of the invention advantageously makes it possible to assist the pressure buildup in the heating volume in the event of a switch-off operation by virtue of feeding compressed insulating gas out of the compression volume into the heating volume when the flow intensity is too low to effect a sufficient pressure increase in the heating volume. In the case of high flow intensities which effect a pressure in the heating volume which is sufficient for quenching the arc, the compression volume is advantageously closed by the overflow valve, with the result that no insulating gas escapes out of the heating volume into the compression volume in such a way as to reduce the pressure.

A development of the abovementioned configuration of the invention provides that the overflow valve closes at least one connecting opening between the cold gas region and the hot gas region of the heating volume when the pressure in the heating volume is lower than the pressure in the compression volume. This development of the invention utilizes the overflow valve not only for closing the compression volume in the event of high pressures in the heating volume but also for at least partially closing the hot gas region in the event of low pressures in the hot gas region. As a result, in the event of low pressures in the hot gas region, advantageously compressed insulating gas is conveyed from the compression volume only or at least predominantly into the cold gas region, with the result that the compressed insulating gas from the compression volume in the cold gas region produces a greater pressure increase than would be the case if the compressed insulating gas from the compression volume were distributed uniformly over the entire heating volume.

A further configuration of the invention provides that the cold gas channel protrudes further into the nozzle channel than the hot gas channel. This configuration of the invention also has the effect that, on separation of the arcing contact pieces, the hot gas channel is unblocked earlier than the cold gas region, with the advantages already mentioned above.

A circuit breaker according to the invention has an interrupter unit according to the invention having the advantages already mentioned above.

BRIEF DESCRIPTION OF THE SEVERAL VIEWS OF THE DRAWING

The above-described properties, features and advantages of this invention and the way and manner in which these are achieved will become clearer and more readily understandable in connection with the description below of exemplary embodiments, which are explained in more detail in connection with the drawings, in which.

DESCRIPTION OF THE INVENTION

Mutually corresponding parts have been provided with the same references in the figures.

Figure 1:
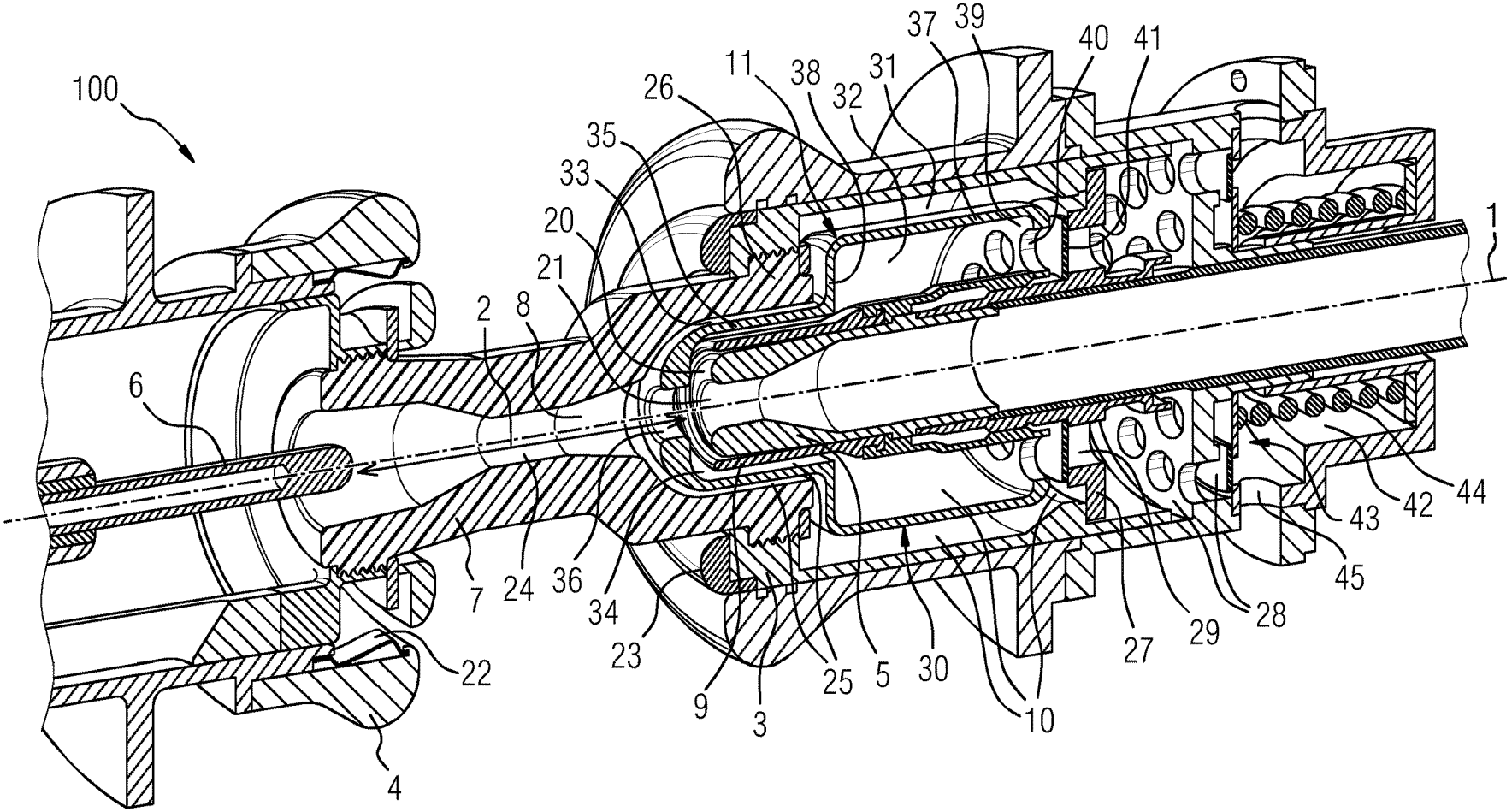
FIG. 1 shows a perspective sectional illustration of a first exemplary embodiment of an interrupter unit.

FIG. 1 shows a perspective sectional illustration of a first exemplary embodiment of an interrupter unit 100 for a circuit breaker.

The interrupter unit 100 has a substantially rotationally symmetrical structure, which extends about a longitudinal axis 1. The interrupter unit 100 has a first arcing contact piece 5 and a second arcing contact piece 6. A first rated current contact piece 3 is assigned to the first arcing contact piece 5. A second rated current contact piece 4 is assigned to the second arcing contact piece 6. The rated current contact pieces 3, 4 and the arcing contact pieces 5, 6 are each formed so as to be rotationally symmetrical with respect to the longitudinal axis 1 and are arranged coaxially with respect to the longitudinal axis 1.

The first arcing contact piece 5 is in the form of a tube and has a contact end 20, which faces the second arcing contact piece 6 and has a tulip-shaped contact opening 21, as well as a protective sleeve 9, which surrounds an end section and consists of an electrically insulating material. The second arcing contact piece 6 is in the form of a pin in order to be capable of moving, with electrical contact, into the contact opening 21 in the first arcing contact piece 5. The second rated current contact piece 4 has a multiplicity of contact fingers 22, which are elastically deformable and can be brought onto a lateral surface 23 of the first rated current contact piece 3 in order to make contact with the first rated current contact piece 3. The first rated current contact piece 3 and the first arcing contact piece 5 are associated with one another and always have the same electrical potential irrespective of a switching state of the interrupter unit 100. The second rated current contact piece 4 and the second arcing contact piece 6 are likewise associated with one another and always have the same electrical potential irrespective of the switching state of the interrupter unit 100.

The rated current contact pieces 3, 4 and the arcing contact pieces 5, 6 are movable relative to one another along the longitudinal axis 1 between a switch-off position (illustrated in FIG. 1) and a switch-on position. In the switch-off position, the two arcing contact pieces 5, 6 are separated from one another by a switching path 2. Correspondingly, in the switch-off position, the two rated current contact pieces 3, 4 are separated from one another.

In the switch-on position, the second arcing contact piece 6 has been moved into the contact opening 21 in the first arcing contact piece 5 and the contact fingers 22 of the second rated current contact piece 4 bear against the lateral surface 23 of the first rated current contact piece 3. In this case, during a switch-on operation the arcing contact pieces 5, 6 come into contact with one another temporally prior to the rated current contact pieces 3, 4. During a switch-off operation, first the rated current contact pieces 3, 4 and temporally thereafter the arcing contact pieces 5, 6 are separated.

On contact-making between and separation of the arcing contact pieces 5, 6, in each case an arc is produced between the arcing contact pieces 5, 6. In order to direct and conduct the arc, an insulating nozzle 7 is provided. The insulating nozzle 7 has a nozzle channel 8. The nozzle channel 8 is rotationally symmetrical and has a channel constriction 24 having a diameter corresponding to a diameter of the second arcing contact piece 6.

The insulating nozzle 7 at least partially surrounds the switching path 2 and is aligned coaxially with respect to the longitudinal axis 1. The nozzle channel 8 widens toward a nozzle channel end section 25, into which the first arcing contact piece 5 protrudes.

On the outer lateral surface side, the insulating nozzle 7 has a peripheral nozzle collar 26, which runs in the form of a ring around the first arcing contact piece 5 and is mounted in a mirror-inverted cutout in the first rated current contact piece 3.

A heating volume 10 adjoins the nozzle channel end section 25, said heating volume surrounding a section of the first arcing contact piece 5. The heating volume 10 extends radially with respect to the longitudinal axis 1 between an outer surface of the first arcing contact piece 5 and an inner surface of the first rated current contact piece 3. The heating volume 10 extends axially with respect to the longitudinal axis 1 between an end of the insulating nozzle 7 which is remote from the second arcing contact piece 6 and a compression wall 27, which separates the heating volume 10 from a compression volume 28.

The compression wall 27 is connected to the first arcing contact piece 5 and, during a switch-off operation, moves with the first arcing contact piece 5 away from the second arcing contact piece 6, wherein the compression volume 28 reduces in size during the movement and compresses insulating gas in the compression volume 28. The compression wall 27 has a plurality of compression wall openings 29 to the heating volume 10.

A separating housing 11 splits the heating volume 10 into a cold gas region 31 and a hot gas region 25. In addition, the separating housing 11 splits the nozzle channel end section 25 into a cold gas channel 33, which is connected to the cold gas region 31, and a hot gas channel 34, which is connected to the hot gas region 32. The separating housing 11 is designed so as to be substantially rotationally symmetrical about the longitudinal axis 1 and surrounds an end section of the first arcing contact piece 5, said end section having the contact end 20.

The separating housing 11 is in the form of a funnel having a housing body 30 arranged in the heating volume 10 and a housing neck protruding into the nozzle channel end section 25.

The housing neck has a hollow-cylindrical channel separating wall 35 between the cold gas channel 33 and the hot gas channel 34 and a housing opening 36 in the separating housing 11 on the switching path side. The cold gas channel 33 is delimited by an outer surface of the channel separating wall 35 and an inner surface, delimiting the nozzle channel end section 25, of the insulating nozzle 7. The hot gas channel 34 is delimited by an inner surface of the channel separating wall 35 and an outer surface of the first arcing contact piece 5.

The housing body 30 of the separating housing 11 is formed by a housing jacket 37, a housing shoulder 38 and a housing collar 39. The housing jacket 37 is in the form of a hollow cylinder, whose cylinder axis is the longitudinal axis 1 and which has a greater inner diameter than the channel separating wall 35. The housing shoulder 38 connects the housing jacket 37 to the channel separating wall 35. The housing collar 39 forms an end of the separating housing 11, said end being remote from the switching path 2 and facing the compression volume 28. The housing collar 39 protrudes inwards from the housing body 30 and extends from the housing body 30 up to the first arcing contact piece 5, which has been passed through the housing collar 39. The housing collar 39 runs parallel to the compression wall 27 and is spaced apart from the compression wall 27. The housing collar 39 has a plurality of connecting openings 40, which are opposite the compression wall openings 29 in the compression wall 27. That region of the heating volume 10 which is surrounded by the separating housing 11 forms the hot gas region 32 of the heating volume 10, and the remaining region of the heating volume 10 forms the cold gas region 31.

An overflow valve 41 is arranged between the compression wall openings 29 in the compression wall 27 and the connecting openings 40 in the housing collar 39, said overflow valve running in the form of a ring around the first arcing contact piece 5. The overflow valve 41 is movable between a first valve position (illustrated in FIG. 1) and a second valve position. In the first valve position, the overflow valve 41 closes the compression wall openings 29 in the compression wall 27, and in the second valve position, the overflow valve 41 closes the connecting openings 40 in the housing collar 39. The valve position of the overflow valve 41 is dependent on the pressure difference between the pressure in the compression volume 28 and the pressure in the heating volume 10 in the region of the overflow valve 41. If the pressure in the compression volume 28 is lower than this pressure in the heating volume 10, the overflow valve 41 assumes the first valve position. If the pressure in the compression volume 28 is higher than the pressure in the heating volume 10, the overflow valve 41 assumes the second valve position.

A pressure release chamber 42 is arranged downstream of the compression volume 28, said pressure release chamber having an excess pressure valve 43 to the compression volume 28. If the pressure in the compression volume 28 exceeds a pressure threshold value, the excess pressure valve 43 opens, with the result that insulating gas can flow out of the compression volume 28 into the pressure release chamber 42 and out of the pressure release chamber 42 through chamber openings 45 in the pressure release chamber 42. The excess pressure valve 43 in this exemplary embodiment is spring-loaded, with the result that the pressure threshold value is determined by a prestress of a spring 44.

During operation of the interrupter unit 100, the interrupter unit 100 is filled with an insulating gas, for example with sulfur hexafluoride, nitrogen or another suitable gas. Insulating gas is located in particular in the nozzle channel 8, the heating volume 10 and the compression volume 28.

During a switch-off operation, in which the arcing contact pieces 5, 6 are separated from one another, burning of an arc between the two arcing contact pieces 5, 6 occurs. The arc heats insulating gas located in its vicinity, and this insulating gas then expands and flows predominantly through the hot gas channel 34 into the hot gas region 32 of the heating volume 10 since the hot gas channel 34 is unblocked prior to the cold gas channel 33 on separation of the arcing contact pieces 5, 6. The insulating gas flowing into the hot gas region 32 increases the pressure in the hot gas region 32. At the same time, on separation of the arcing contact pieces 5, 6, the insulating gas in the compression volume 28 is compressed owing to the movement of the compression wall 28 and the pressure in the compression volume 28 is increased.

The pressure increase in the hot gas region 32 is dependent on the flow intensity. In the case of low flow intensities, the pressure increase in the hot gas region 32 is relatively small, with the result that the pressure generated in the compression volume 28 becomes higher than the pressure in the hot gas region 32 and the overflow valve 41 assumes the second valve position, in which it closes the connecting openings 40 in the housing collar 39 of the separating housing 11. As a result, the cold gas region 31 is separated from the hot gas region 32 and is connected to the compression volume 28 via the compression wall openings 29 in the compression wall 27, with the result that insulating gas flows out of the compression volume 28 into the cold gas region 31. Once the cold gas channel 33 has been unblocked, the insulating gas flows out of the cold gas region 31 through the cold gas channel 33 to the arc and finally quenches the arc. Since the hot gas region 32 in this case has been closed by means of the overflow valve 41, the insulating gas flowing out of the compression volume 28 reduces the available space in the heating volume 10 to the cold gas region 31, as a result of which, advantageously, the pressure in the insulating gas and therefore the quenching effect of the insulating gas are increased in comparison with a situation in which insulating gas flows out of the compression volume 28 into the entire heating volume 10.

In the case of high flow intensities, the pressure increase in the hot gas region 32 is correspondingly great, with the result that the pressure in the hot gas region 32 is higher than the pressure generated in the compression volume 28 and the overflow valve 41 assumes the first valve position, in which it unblocks the connecting openings 40 in the housing collar 39 of the separating housing 11 and closes the compression wall openings 29 in the compression wall 27. As a result, heated insulating gas flows through the connecting openings 40 out of the hot gas region 32 into the cold gas region 31 and increases the pressure in the cold gas region 31. If the arc loses intensity and the backflow of insulating gas out of the heating volume to the arc begins, insulating gas flows both out of the cold gas region 31 through the cold gas channel 33 and out of the hot gas region 32 through the hot gas channel 34 to the arc and finally quenches the arc. In this case, the interaction between the cold gas channel 33 and the hot gas channel 34 improves the quenching effect of the insulating gas by virtue of enlarging the axial extent over which insulating gas flows over the arc. A hazardous excess pressure arising in the compression volume 28 is dissipated via the pressure release chamber 42.

Figure 2:
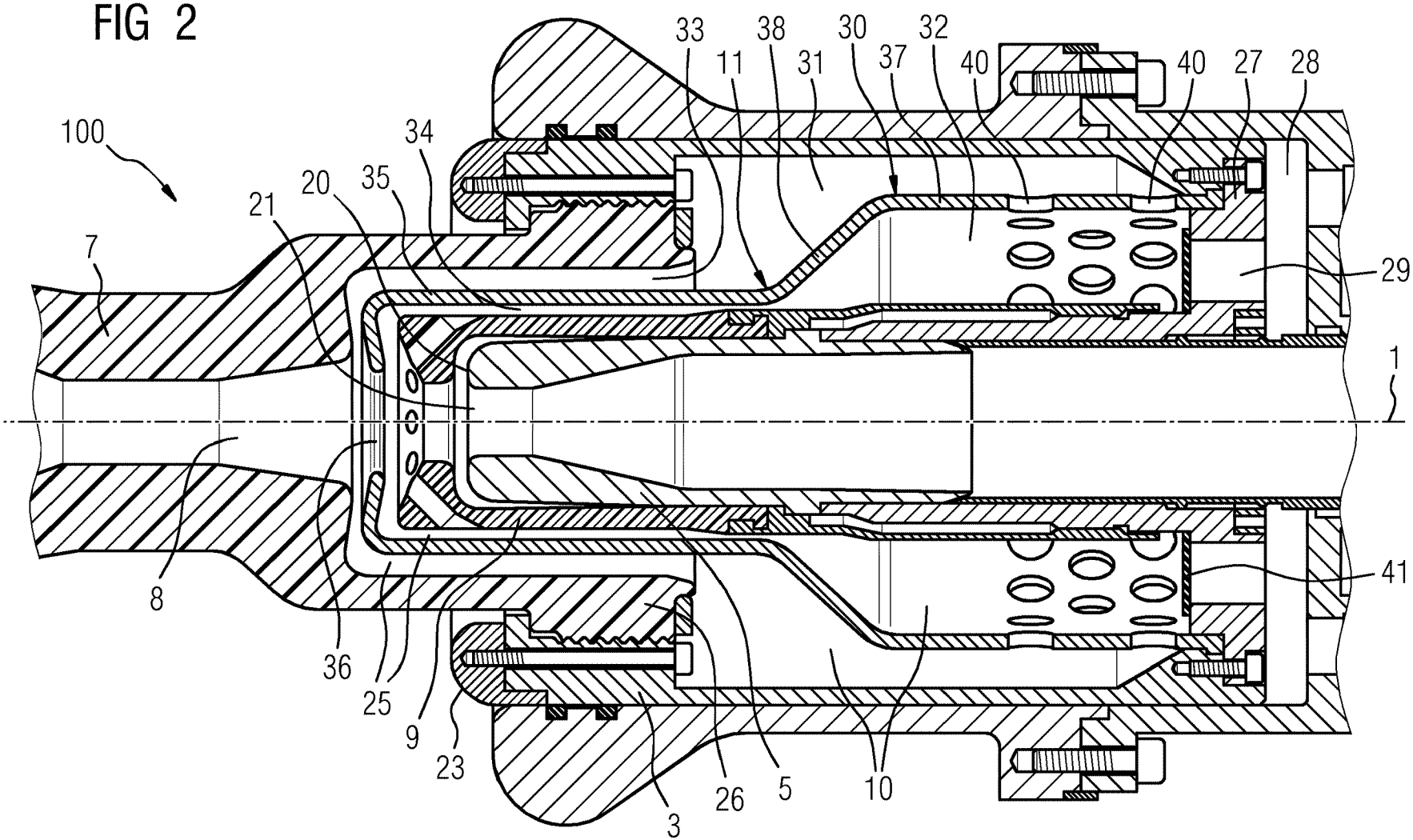
FIG. 2 shows a sectional illustration of a second exemplary embodiment of an interrupter unit.

FIG. 2 shows a sectional illustration of a second exemplary embodiment of an interrupter unit 100 for a circuit breaker. This exemplary embodiment differs from the exemplary embodiment illustrated in FIG. 1 substantially only in the configuration and arrangement of the separating housing 11 and the shape of the nozzle channel end section 25 as well as the associated configuration of the cold gas region 31, the hot gas region 32, the cold gas channel 33 and the hot gas channel 34.

The separating housing 11 is in the form of a funnel with a housing body 30 arranged in the heating volume 10 and a housing neck protruding into the nozzle channel end section 25.

The housing neck differs from the housing neck of the separating housing 11 illustrated in FIG. 1 in that the end of the housing neck has the same wall thickness as the remaining housing neck, whereas the end of the housing neck of the separating housing 11 illustrated in FIG. 1 has a greater wall thickness than the remaining housing neck. In addition, the end of the housing neck is bent back slightly toward the contact end 20 of the first arcing contact piece 5.

The housing body 30 differs from the housing body 30 of the separating housing 11 illustrated in FIG. 1 in that it does not have a housing collar 39, in that the housing jacket 37 has a plurality of connecting openings 40 to the cold gas region 31, and in that the housing shoulder 38 is less steep. The housing jacket 37 is connected to the compression wall 27. The compression wall openings 29 in the compression wall 27 open directly into the hot gas region 32. The overflow valve 41 is arranged in front of the compression wall openings 29 in the hot gas region 32.

The overflow valve 41 is movable between a first valve position (illustrated in FIG. 2) and a second valve position. In the first valve position, the overflow valve 41 closes the compression wall openings 29 in the compression wall 27, and in the second valve position, the overflow valve 41 opens the compression wall openings 29, wherein said overflow valve is spaced apart from the compression wall openings 29. The valve position of the overflow valve 41 is dependent on the pressure difference between a pressure in the compression volume 28 and a pressure in the hot gas region 32. If the pressure in the compression volume 28 is lower than the pressure in the hot gas region 32, the overflow valve 41 assumes the first valve position. If the pressure in the compression volume 28 is higher than the pressure in the hot gas region 32, the overflow valve 41 assumes the second valve position.

In contrast to the exemplary embodiment illustrated in FIG. 1, the connecting openings 40 in the separating housing 11 which connect the hot gas region 32 to the cold gas region 31 cannot be closed.

Correspondingly, during a switch-off operation, insulating gas always flows out of the hot gas region 32 into the cold gas region 31, in particular even at low flow intensities. As in the case of the exemplary embodiment illustrated in FIG.

1, the overflow valve 31 closes the compression wall openings 29 in the event of high flow intensities, with the result that the arc in this case is only quenched by insulating gas from the cold gas region 31 and the hot gas region 32. In the case of low flow intensities, insulating gas from the compression volume 28 also takes part, and this insulating gas enters the hot gas region 32 through the compression wall openings 29 and from there is directed through the overflow valve 41 arranged in front of the compression wall openings 40 predominantly to connecting openings 40 and flows through these connecting openings 40 into the cold gas region 31, with the result that the insulating gas flowing out of the compression volume 28 flows predominantly into the cold gas region 31.

Although the invention has been illustrated and described in more detail by preferred exemplary embodiments, the invention is not restricted by the disclosed examples and other variations can be derived herefrom by a person skilled in the art without departing from the scope of protection of the invention.

The invention claimed is:

1. An interrupter unit for a circuit breaker, the interrupter unit comprising:

two electrically conductive arcing contact pieces that are movable relative to one another along a switching path between a switch-off position, in which said arcing contact pieces are separated from one another by said switching path, and a switch-on position, in which said arcing contact pieces are in electrical contact with one another;

an insulating nozzle at least partially surrounding said switching path and having a nozzle channel that passes through said insulating nozzle and through which said switching path passes;

a heating volume connected to said nozzle channel;

a compression wall disposed to separate a compression volume from said heating volume;

a separating housing disposed to split said heating volume into a cold gas region and a hot gas region, said separating housing having at least one connecting opening formed therein connecting said cold gas region to said hot gas region;

an overflow valve configured to close said at least one connecting opening between said cold gas region and said hot gas region when a pressure in said heating volume is lower than a pressure in said compression volume;

a cold gas channel extending through a nozzle channel end section of said nozzle channel and being connected to said cold gas region of said heating volume; and a hot gas channel extending through said nozzle channel end section of said nozzle channel and being connected to said hot gas region of said heating volume.

2. The interrupter unit according to claim 1, wherein said arcing contact pieces include a first arcing contact piece having a contact end formed with a contact opening, and a second arcing contact piece configured to move into said contact opening of said contact end in the switch-on position, and wherein said hot gas channel surrounds said contact end of said first arcing contact piece and said cold gas channel surrounds said hot gas channel.

3. The interrupter unit according to claim 1, comprising a channel separating wall separating said cold gas channel and said hot gas channel from one another.

4. The interrupter unit according to claim 3, wherein said channel separating wall is substantially in a form of a hollow cylinder.

5. The interrupter unit according to claim 3, wherein said channel separating wall protrudes into said nozzle channel end section, and said cold gas channel is delimited by an outer surface of said channel separating wall and an inner surface of said insulating nozzle delimiting said nozzle channel end section.

6. The interrupter unit according to claim 3, wherein said channel separating wall is a part of said separating housing.

7. The interrupter unit according to claim 6, wherein said channel separating wall forms a housing end section, facing said switching path, of said separating housing.

8. The interrupter unit according to claim 6, wherein said separating housing is funnel-shaped, wherein said channel separating wall forms a housing neck, which protrudes into said nozzle channel end section and which is adjoined by a housing body, which is arranged in said heating volume and has an inner diameter greater than said housing neck.

9. The interrupter unit according to claim 1, wherein said nozzle channel widens toward said nozzle channel end section.

10. The interrupter unit according to claim 1, wherein:

said compression wall is coupled to one of said arcing contact pieces in order to reduce a size of said compression volume upon a relative movement of said arcing contact pieces from the switch-on position into the switch-off position.

11. The interrupter unit according to claim 1, wherein said cold gas channel protrudes farther into said nozzle channel than said hot gas channel.

12. An interrupter unit for a circuit breaker, the interrupter unit comprising:

two electrically conductive arcing contact pieces that are movable relative to one another along a switching path between a switch-off position, in which said arcing contact pieces are separated from one another by said switching path, and a switch-on position, in which said arcing contact pieces are in electrical contact with one another;

an insulating nozzle at least partially surrounding said switching path and having a nozzle channel that passes through said insulating nozzle and through which said switching path passes;

a heating volume connected to said nozzle channel;

a separating housing disposed to split said heating volume into a cold gas region and a hot gas region, said separating housing having at least one connecting opening formed therein connecting said cold gas region to said hot gas region;

a cold gas channel extending through a nozzle channel end section of said nozzle channel and being connected to said cold gas region of said heating volume;

a hot gas channel extending through said nozzle channel end section of said nozzle channel and being connected to said hot gas region of said heating volume;

a compression wall separating a compression volume from said heating volume, said compression wall being coupled to one of said arcing contact pieces in order to reduce a size of said compression volume upon a relative movement of said arcing contact pieces from the switch-on position into the switch-off position;

said compression wall having at least one compression wall opening formed therein and an overflow valve closing said compression wall opening when a pressure in said heating volume in a region of said overflow valve is higher than a pressure in said compression volume; and wherein said overflow valve is configured to close at least one connecting opening between said cold gas region and said hot gas region when the pressure in said heating volume is lower than the pressure in said compression volume.

* * * * *